US010368667B1

(12) United States Patent
Cioffi

(10) Patent No.: US 10,368,667 B1
(45) Date of Patent: Aug. 6, 2019

(54) DEVICE FOR HYDRATING AND REPLENISHING CALORIES AND NUTRIENTS IN A STERILE SETTING

(71) Applicant: Joseph Halliday Cioffi, Santa Monica, CA (US)

(72) Inventor: Joseph Halliday Cioffi, Santa Monica, CA (US)

( * ) Notice: Subject to any disclaimer, the term of this patent is extended or adjusted under 35 U.S.C. 154(b) by 0 days.

(21) Appl. No.: 15/866,300

(22) Filed: Jan. 9, 2018

Related U.S. Application Data

(60) Provisional application No. 62/444,052, filed on Jan. 9, 2017.

(51) Int. Cl.

| | |
|---|---|
| ***B65D 33/06*** | (2006.01) |
| ***A47G 19/22*** | (2006.01) |
| ***B65D 77/06*** | (2006.01) |
| ***B65D 25/20*** | (2006.01) |
| *B65D 37/00* | (2006.01) |

(52) U.S. Cl.
CPC ..... *A47G 19/2266* (2013.01); *B65D 25/20* (2013.01); *B65D 77/06* (2013.01); *A47G 2400/02* (2013.01)

(58) Field of Classification Search
CPC ..... A47G 19/2266; A47G 2400/02; B65D 25/20; B65D 77/06
USPC ..... 220/705, 737, 739, 740
See application file for complete search history.

(56) References Cited

U.S. PATENT DOCUMENTS

| | | | | |
|---|---|---|---|---|
| 5,385,264 | A * | 1/1995 | Kaufman | A47G 19/2266 215/388 |
| 5,437,389 | A * | 8/1995 | Kaufman | A47G 19/2266 206/217 |
| 5,671,864 | A * | 9/1997 | Caruthers | A47G 19/22 220/737 |
| 5,957,584 | A * | 9/1999 | Lakey | B65D 75/5883 383/104 |
| 6,019,245 | A * | 2/2000 | Foster | B65D 81/3881 215/11.6 |
| 6,325,237 | B1 * | 12/2001 | Gish | A47G 23/0216 220/737 |
| 6,601,728 | B1 * | 8/2003 | Newkirk | A47G 23/0216 220/739 |
| 2002/0108960 | A1 * | 8/2002 | Watson | B65D 81/3879 220/739 |
| 2004/0232156 | A1 * | 11/2004 | Hogan | A47G 23/0216 220/737 |
| 2009/0107866 | A1 * | 4/2009 | Dunn-Rankin | B65D 77/28 206/363 |
| 2010/0206756 | A1 * | 8/2010 | Dunn-Rankin | B65D 75/366 206/467 |
| 2013/0126370 | A1 * | 5/2013 | Diliberto | B65D 81/3266 206/219 |

(Continued)

*Primary Examiner* — J. Gregory Pickett
*Assistant Examiner* — Niki M Eloshway
(74) *Attorney, Agent, or Firm* — Plager Schack LLP

(57) ABSTRACT

A device for hydrating and replenishing calories and nutrients in a sterile setting without compromising the sterility of the setting may include a container sized to accommodate a volume of a supplement; a straw extending from the container, the straw designed to transport the supplement from the container to a user; and a protective sleeve attached to and surrounding the container, the protective sleeve defining at least one channel sized to accommodate the user's hand.

3 Claims, 3 Drawing Sheets

(56) References Cited

U.S. PATENT DOCUMENTS

| | | | | |
|---|---|---|---|---|
| 2015/0069056 | A1* | 3/2015 | Kishimoto | B65D 77/04<br>220/23.87 |
| 2016/0297591 | A1* | 10/2016 | You | B65D 75/008 |

* cited by examiner

FIG.1
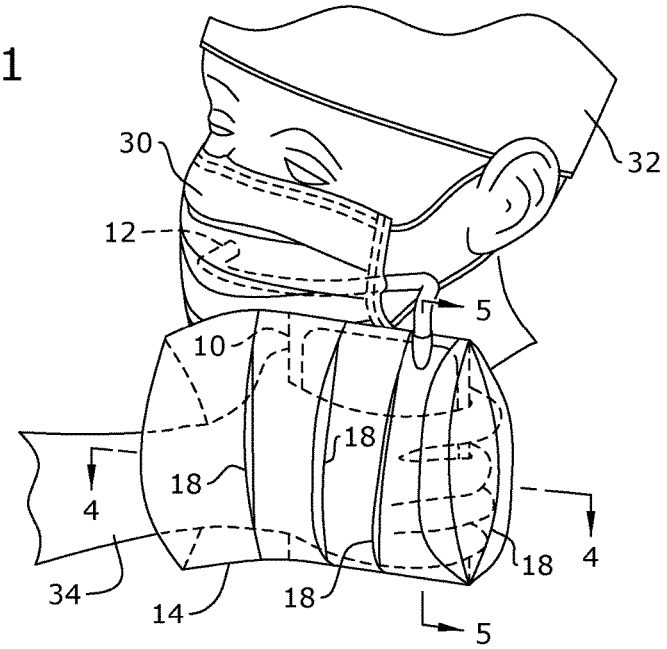
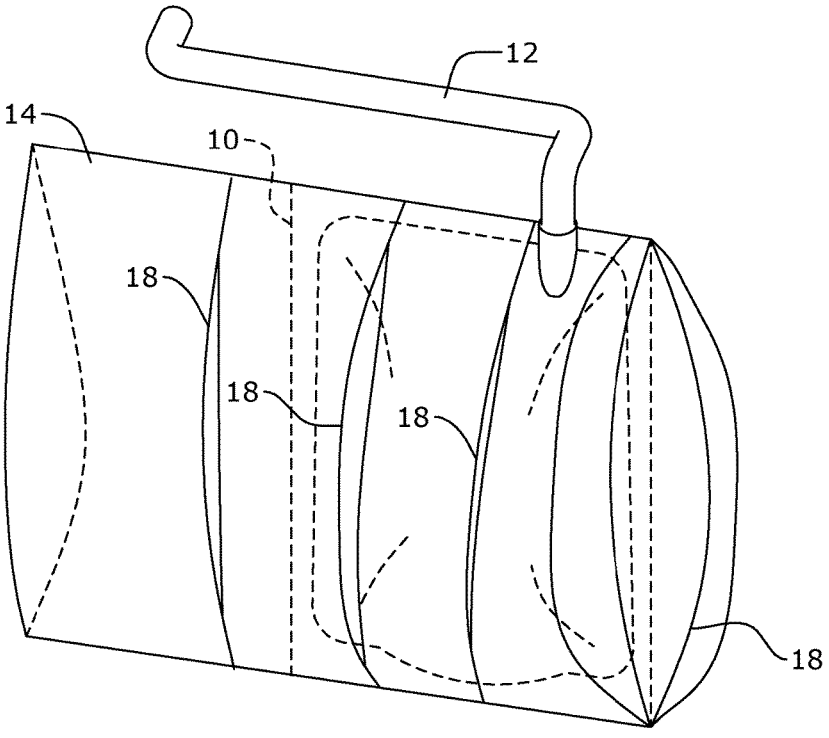
FIG.2

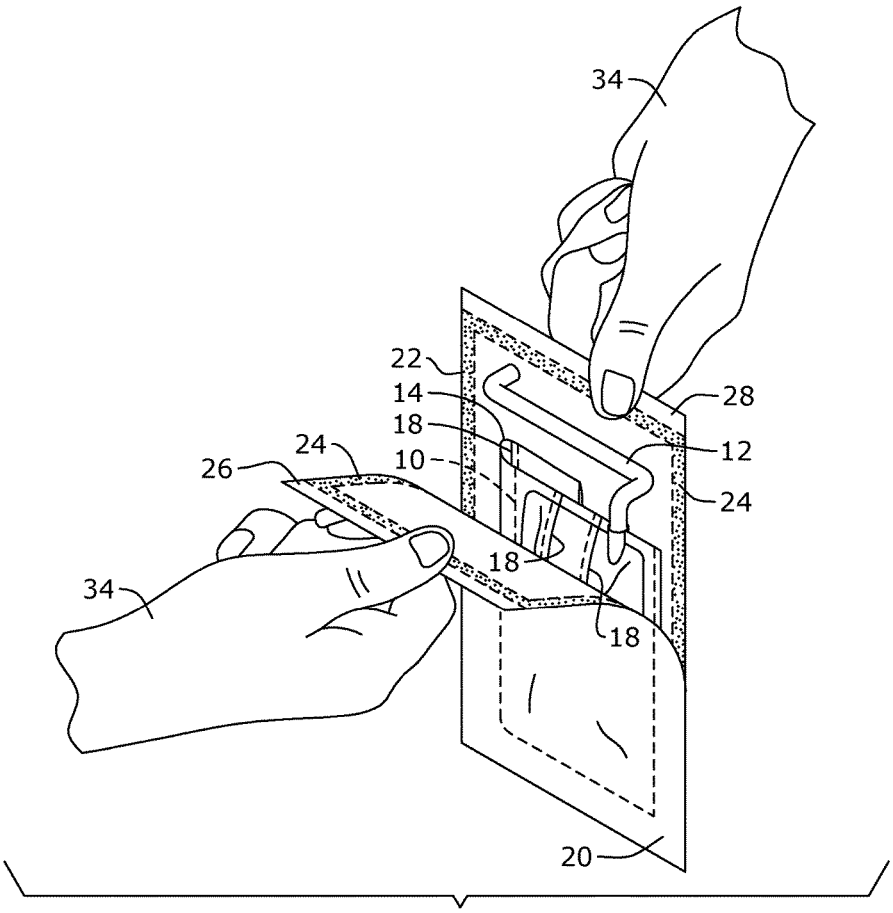
FIG.3
FIG.4
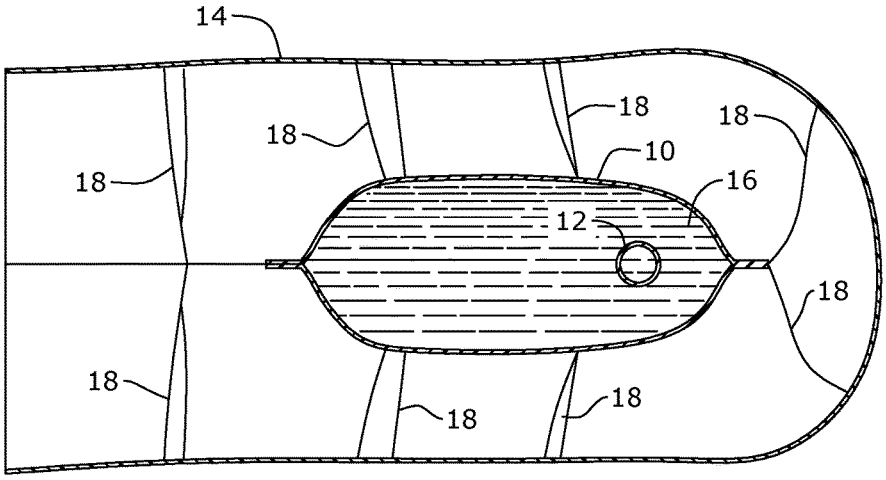

DEVICE FOR HYDRATING AND REPLENISHING CALORIES AND NUTRIENTS IN A STERILE SETTING

RELATED APPLICATION

This application claims priority to provisional patent application U.S. Ser. No. 62/444,052 filed on Jan. 9, 2017, the entire contents of which is herein incorporated by reference.

BACKGROUND

The embodiments described herein relate generally to medical devices, and more particularly, to a device for hydrating and replenishing calories and nutrients in people working in sterile settings.

Sterile work environments often place employees in the precarious position of working extended periods of time without the ability to replenish essential nutrients and stay hydrated due to the time consuming nature of entering and exiting sterile fields. Furthermore, these industries tend to be high stress and deal with high value commodities. Having workers not functional at their energy capacity may affect productivity, failure rate, and quality of life. Nowhere is this more apparent than in the medical realm, where the lives of patients are in the hands of surgeons who work for hours without breaks, yet are expected to maintain their mental and physical capabilities throughout the high stress periods of time without the necessary nutrients and hydration.

Therefore, what is needed is a device to deliver nutrients and hydrating liquids to a user without compromising a sterile setting.

SUMMARY

Some embodiments of the present disclosure include a device for hydrating and replenishing calories and nutrients in a sterile setting without compromising the sterility of the setting. The device may include a container sized to accommodate a volume of a supplement; a straw extending from the container, the straw designed to transport the supplement from the container to a user; and a protective sleeve attached to and surrounding the container, the protective sleeve defining at least one channel sized to accommodate the user's hand.

BRIEF DESCRIPTION OF THE FIGURES

The detailed description of some embodiments of the invention is made below with reference to the accompanying figures, wherein like numerals represent corresponding parts of the figures.

FIG. 1 is a perspective view of one embodiment of the present disclosure, shown in use.

FIG. 2 is a perspective view of one embodiment of the present disclosure.

FIG. 3 is a perspective view of one embodiment of the present disclosure.

FIG. 4 is a section view of one embodiment of the present disclosure, taken along line 4-4 in FIG. 1.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to provide nutrients and hydrating liquids to a user in a sterile setting without compromising the sterility of the setting and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Nutrient Container
2. Outer Packaging Sleeve
3. Straw

The various elements of the device of the present disclosure may be related in the following exemplary fashion. It is not intended to limit the scope or nature of the relationships between the various elements and the following examples are presented as illustrative examples only.

Figure 5:
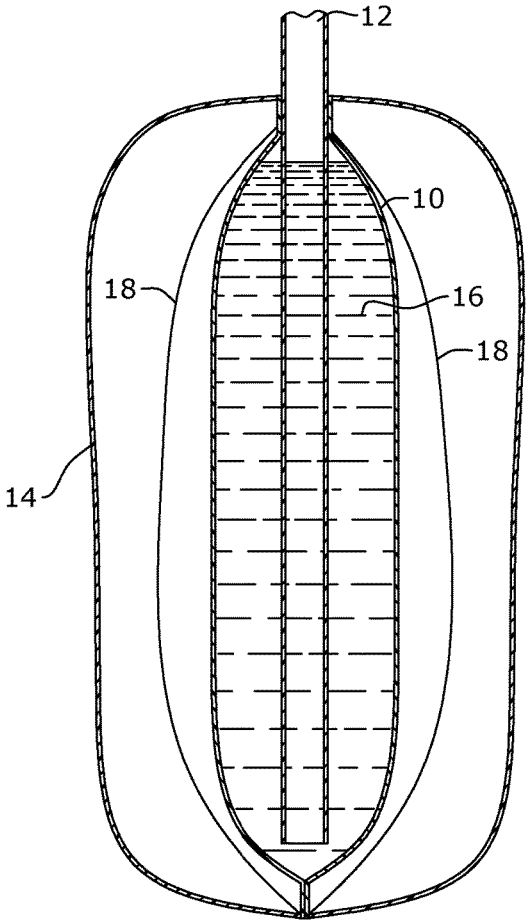
FIG. 5 is a section view of one embodiment of the present disclosure, taken along line 5-5 in FIG. 1.
Figure 6:
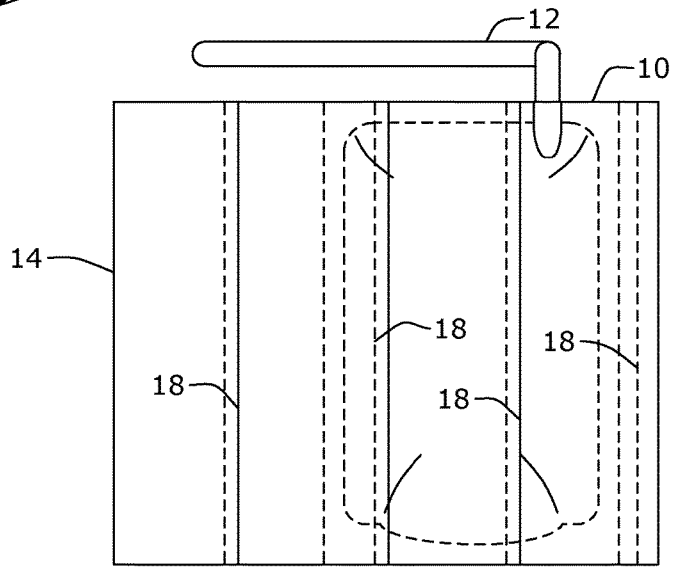
FIG. 6 is a front view of one embodiment of the present disclosure.

By way of example, and referring to FIGS. 1-6, some embodiments of the present disclosure include a device for hydrating and replenishing calories and nutrients in a sterile setting without compromising the sterility of the setting, the device comprising a container 10 sized to accommodate a volume of a supplement 18; a mouthpiece, such as a straw 12, extending from the container 10, the mouthpiece designed to transport the supplement 18 from the container 10 to the user 32; and a protective sleeve 14 attached to and surrounding the container 10, such that a user 32 may insert his or her hands 34 into the sleeve 14 to grab the container 10, and the sleeve 14 may help prevent the user 32 from being exposed to nonsterile fields, thus helping to maintain the sterility of the environment. In embodiments, and as shown in the Figures, the outer sleeve 14 may comprise a plurality of expansion pleats 18 designed to expand when a user 32 places his or hand 34 into the sleeve 14.

While the Figures show the mouthpiece comprising a straw 12, the use of other conventional mouthpieces are envisioned so long as the mouthpiece allows a user to drink from the device without removing a facemask. Moreover, the mouthpiece or straw 12 may comprise a reflux valve. In embodiments including the straw 12, the straw 12 may either be a singular piece with the container 10, or the straw 12 may be removably attached to the container 10. For example, the straw 12 may extend from a cap that may screw on, snap on, or otherwise attach to an opening in the container 10.

As shown in, for example, FIG. 3, the container 10, attached sleeve 14, and mouthpiece, such as straw 12, may be completely sealed within an outer packaging before use, thus ensuring the sterility of the container 10, the attached sleeve 14, and the mouthpiece. In some embodiments, the outer packaging may comprise a front panel 20 sealed to a back panel 22 such that the outer packaging is sealed around the container 10. The panels 20, 22 may be sealed together via an adhesive 24 or by using a vacuum sealing process. When the container 10, the attached sleeve 14, and the straw 12 are sealed within the outer packaging, the seal may keep the straw 12 closed to prevent unintentional spilling of the supplement 18. In embodiments, at least one outer edge of each panel may form a pull tab 26, 28 such that when a non-sterile person pulls on each of the pull tabs 26, 28, the front panel 20 peels away from the back panel 22, granting access to the sterile container 10.

Because in sterile settings a user 32 may often wear a mask 30, the straw 12 may be specifically designed to be used without removing the mask 30. For example, as shown in FIG. 2, the straw 12 may comprise an extended portion having a length sufficient to reach from an area outside of the side of the mask 30 to the user's mouth. Proximate to the user's mouth, the straw 12 may include an elbow designed to position the straw 12 opening such that it is easily accessed by the user 32.

While not shown in the Figures, the straw 12 may include a structural component designed to seal the supplement 18 within the container 10 when the user 32 is not ingesting the supplement 18. Thus, the straw 12 may include a structural component to prevent the contents of the container 10 from leaking or spilling during transport and storage. The structural component may comprise, for example, a physical barrier or seal at the open end thereof, wherein a user 32 may bite the straw 12 to break the barrier/seal. Alternatively, the straw 12 may include a sliding lock, wherein the user 34 may slide the lock to open the end of the straw 12. In such an embodiment, the straw 12 may also be resealable. In any case, any structural component that may temporarily or releasably seal the straw 12 and the contents within the container 10 may be used.

In some embodiments, the straw 12 may be physically attached or clamped to the container 10. In other embodiments, the straw 12 may initially be packaged with the container but may have to be inserted into the container 10 for use, similar to a conventional juice box.

The device of the present disclosure may be made using any desired materials. The supplement 18 may comprise any desired supplement, hydrating liquid, nourishment, or the like. For example, the supplement 18 may comprise water, any other beverage, applesauce, or any other drinkable nutritious food item.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A device for hydrating and replenishing calories and nutrients in a sterile setting without compromising the sterility of the setting, the device comprising:

a container sized to accommodate a volume of a supplement;

a straw extending from the container, the straw designed to transport the supplement from the container to a user; and a protective sleeve further comprising a protective sleeve first panel joined to a protective sleeve second panel by at least two pleats; wherein the protective sleeve is attached to the container by at least two additional pleats, such that the protective sleeve surrounds the container, the protective sleeve defining at least one channel sized to accommodate the user's hand, wherein:

the protective sleeve seals the container at a top surface and a bottom surface thereof with a top and bottom seam, respectively; and the straw extends from the container and through the protective sleeve.

2. The device of claim 1, wherein the outer packaging comprises an outer packaging first panel immediately adjacent to the protective sleeve first panel; and an outer packaging second panel immediately adjacent to the protective sleeve second panel;

a first adhesive strip, joining an outer packaging first panel first edge to the outer packaging second panel first edge;

a second adhesive strip, joining an outer packaging first panel second edge to the outer packaging second panel second edge.

3. The device of claim 2, wherein the outer packaging further comprises a a first pull tab, arranged above the first adhesive strip;

a second pull tab, arranged above the first adhesive strip;

wherein pulling the first pull tab apart from the second pull tab separates the first adhesive strip from the second adhesive strip opening the outer packaging.

* * * * *